US010227777B2

(12) United States Patent
Karle et al.

(10) Patent No.: US 10,227,777 B2
(45) Date of Patent: Mar. 12, 2019

(54) METHOD FOR PRODUCING A CONCRETE COMPONENT, PREFABRICATED STRUCTURAL ELEMENT OF A CONCRETE COMPONENT, AND CONCRETE COMPONENT

(71) Applicant: Groz-Beckert KG, Albstadt (DE)

(72) Inventors: Roland Karle, Bisingen (DE); Hans Kromer, Winterlingen (DE); Johann Pfaff, Winterlingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 14/899,036

(22) PCT Filed: Jun. 25, 2014

(86) PCT No.: PCT/EP2014/063448
§ 371 (c)(1),
(2) Date: Dec. 16, 2015

(87) PCT Pub. No.: WO2015/000771
PCT Pub. Date: Jan. 8, 2015

(65) Prior Publication Data

US 2016/0130812 A1 May 12, 2016

(30) Foreign Application Priority Data

Jul. 2, 2013 (DE) ..... 10 2013 010 989
Jul. 3, 2013 (DE) ..... 10 2013 011 083

(51) Int. Cl.
*E04C 2/32* (2006.01)
*E04C 2/06* (2006.01)
(Continued)

(52) U.S. Cl.
CPC ..... *E04C 2/06* (2013.01); *B28B 19/003* (2013.01); *B28B 19/0046* (2013.01);
(Continued)

(58) Field of Classification Search
CPC ..... E04C 2/06; E04C 2/044; B28B 23/0006; B28B 23/0062; B28B 19/003
(Continued)

(56) References Cited

U.S. PATENT DOCUMENTS 5,033,248 A * 7/1991 Phillips ..... E04B 1/04 52/742.14
7,790,302 B2 * 9/2010 Ladely (Guevara) .. E04B 5/043 106/778
(Continued)

FOREIGN PATENT DOCUMENTS

CN 2338404 Y 9/1999
CN 2404947 Y 11/2000
(Continued)

OTHER PUBLICATIONS

International Search Report for corresponding International Application No. PCT/EP2014/063448, dated Oct. 13, 2014, 4 pages.
(Continued)

*Primary Examiner* — Basil S Katcheves
(74) *Attorney, Agent, or Firm* — Fitch, Even, Tabin & Flannery LLP

(57) ABSTRACT

The present invention relates to a method of producing a concrete component (15), to a prefabricated structural element (3), which serves as a semi-finished product for the production of the concrete component (15) made in this way, and to a corresponding concrete component (15). The method claimed involves the following steps:

producing a prefabricated structural element (3) comprising first reinforcement structures (18), which feature textile reinforcement structures, and first thermal insulation elements (6), pouring concrete into a shell mold (13) to form a first concrete layer (11), (Continued)

lowering the prefabricated structural element (3) onto the first concrete layer (11).

21 Claims, 5 Drawing Sheets

(51) Int. Cl.

| | |
|---|---|
| ***B28B 19/00*** | (2006.01) |
| ***B28B 23/00*** | (2006.01) |
| ***B28B 23/02*** | (2006.01) |
| ***E04C 2/288*** | (2006.01) |
| ***E04C 2/04*** | (2006.01) |

(52) U.S. Cl.
CPC ..... *B28B 23/0006* (2013.01); *B28B 23/0062* (2013.01); *B28B 23/028* (2013.01); *E04C 2/044* (2013.01); *E04C 2/288* (2013.01)

(58) Field of Classification Search
USPC ..... 52/630, 741.1, 309.11, 309.12, 426
See application file for complete search history.

(56) References Cited

U.S. PATENT DOCUMENTS

| | | | | |
|---|---|---|---|---|
| 2001/0000738 | A1 | 5/2001 | Mathieu | |
| 2001/0010140 | A1 | 8/2001 | Ritter et al. | |
| 2004/0065034 | A1 | 4/2004 | Messenger et al. | |
| 2004/0206032 | A1 | 10/2004 | Messenger et al. | |
| 2005/0009428 | A1* | 1/2005 | Porter | B32B 5/02 442/129 |
| 2005/0284088 | A1* | 12/2005 | Heath | E04B 2/845 52/741.1 |
| 2006/0225376 | A1* | 10/2006 | Foldager | E04C 5/04 52/450 |
| 2015/0033655 | A1 | 2/2015 | Hans et al. | |

FOREIGN PATENT DOCUMENTS

| | | | |
|---|---|---|---|
| CN | 1278884 | A | 1/2001 |
| CN | 202148636 | U | 2/2012 |
| DE | 2756820 | A1 | 6/1978 |
| DE | 10007100 | B4 | 4/2005 |
| DE | 102012101498 | A1 | 7/2013 |
| EP | 0532140 | A1 | 3/1993 |
| JP | S5761013 | U | 4/1982 |
| JP | H08151724 | A | 6/1996 |
| JP | H09504844 | A | 5/1997 |
| JP | 2005315065 | A | 11/2005 |
| JP | 2006089994 | A | 4/2006 |
| JP | 4007756 | B2 | 11/2007 |
| WO | 9428264 | A1 | 12/1994 |

OTHER PUBLICATIONS

International Preliminary Report on Patentability for corresponding International Application No. PCT/EP2014/063448, dated Jun. 16, 2015, 8 pages.

Office action in corresponding Korean Application No. 10-2015-7036955, dated Feb. 26, 2016, 9 pages.

Michael Horstmann, Zum Tragverhalten von Sandwichkonstruktionen aus textilbewehrtem Beton, Von der Fakultät für Bauingenieurwesen der Rheinisch-Westfälischen Technischen Hochschule Aachen zur Erlangung des akademischen Grades eines Doktors der Ingenieurwissenschaften genehmigte Dissertation, dated Dec. 13, 2010, 317 pages.

First Office Action in corresponding Japanese Application No. 2015-563147, dated Feb. 21, 2017, 10 pages.

Second Office Action in corresponding Japanese Application No. 2015-563147, dated Jul. 29, 2017, 7 pages.

First Office Action in corresponding Chinese Application No. 201480037860.0, dated Mar. 10, 2017, 14 pages.

Second Office Action in corresponding Chinese Application No. 201480037860.0, dated Sep. 4, 2017, 11 pages.

German Office Action in corresponding German Application No. 10 2013 011 083.1 dated Apr. 23, 2014, 12 pages.

State Intellectual Property Office, P.R. China, Decision on Rejection dated Apr. 9, 2018 for Chinese Patent Application No. 201480037860.0 (English translation herewith) (13 pgs.).

German Office Action in corresponding German Application No. 10 2013 011 083.1 dated Aug. 31, 2018, with Machine English Translation, 10 pages.

* cited by examiner

METHOD FOR PRODUCING A CONCRETE COMPONENT, PREFABRICATED STRUCTURAL ELEMENT OF A CONCRETE COMPONENT, AND CONCRETE COMPONENT

CROSS REFERENCE TO RELATED APPLICATIONS

This patent application is the national phase of PCT/EP2014/063448 filed Jun. 25, 2014, which claims the benefit of German Patent Application No. 10 2013 010 989.2 filed Jul. 2, 2013 and of German Patent Application No. 10 2013 011 083.1 filed Jul. 3, 2013.

TECHNICAL FIELD

The present invention relates to a method of producing a concrete component, to a prefabricated structural element of a concrete component and to a corresponding concrete component.

BACKGROUND

Concrete components and their production are known. It has been familiar practice for some time to provide such concrete components with insulating elements during their production. The concrete components concerned are frequently panel-shaped, meaning that connections between insulation panels and concrete panels are often involved. Sandwich panels, as they are called, are also frequently produced, in which the insulation layer is sandwiched between two layers of concrete.

Particularly during the preparation of such sandwich elements, the question of a firm connection between the two (exterior) layers of concrete arises, as this connection must pass through the insulation layer without causing a thermal bridge of notable extent.

To this purpose the US20040065034A1 discloses a sandwich element comprising a woven carbon fibre grid connecting two outer concrete layers and passing through a insulation layer. The carbon fibre grid is integrated in somewhat long insulation elements and extends in a plain perpendicular to the surface of the sandwich element. The method for producing such sandwich elements aims primarily in making use of existing fabrication methods for being able to produce great numbers of sandwich elements in a flexible and inexpensive manner. The US20040206032A1 is a "Continuation-in-part" of US20040065034A1. In further developing the US20040065034A1 the US20040206032A1 concentrates on the connection of sandwich elements to one another and to the connection of sandwich elements to buildings. The carbon fibre grids used are the same as in US20040065034A1, see corresponding name of the trademark of the grids.

The EP0532140A1 discloses sandwich elements comprising fiber-reinforced synthetic parts connecting two outer concrete layers. The fiber-reinforced synthetic parts are fixed to tensioned steel ropes connected to a formwork. In some embodiments the fiber-reinforced synthetic parts that are longwise and extend in most cases in one single plain are integral with insulation material The method for casting the sandwich elements discloses different and independent steps for inserting the reinforcement of the concrete layers and for inserting the longwise fiber-reinforced synthetic parts for the connection of the concrete layers.

The DE 100 07 100 B4, among other publications, addresses this problem. It discloses a method in which, to start with, a first concrete layer is formed. Elements for connecting the first concrete layer with the second concrete layer to be added later are applied onto this layer. These rise up perpendicular to the second layer, piercing the insulation layer when this is applied onto the first concrete layer. Pour-in-place PU foam is then used to seal the holes again. Finally, the second concrete layer is poured onto the insulation layer.

The DE 10 2012 101 498 A1, which was not yet part of the prior art when the original application for the present invention was filed, also discloses a sandwich element of such kind, in which the two concrete layers are connected by reinforcing elements that pass through the insulation layer. A method of producing the disclosed component is also described in the last-mentioned publication.

What the two aforementioned publications have in common is that the use of non-metallic reinforcing elements is mentioned.

Practical experience in the production of concrete components shows that specific problems arise from the use of textile reinforcing elements, such as glass fibres or carbon fibre elements. For example, these reinforcing elements weigh less and have a lower compressive strength than metal. The tensile strength of the materials is often anisotropic, and pre-hardened reinforcing grids are very fragile.

The aforementioned low weight can cause reinforcing material applied onto a concrete layer to float up, preventing it from forming close contact with the concrete matrix. One way of avoiding this problem consists in weighting down the fragile reinforcing material with stones or metal put on top, thereby ensuring that reinforcing members remain in the concrete matrix when it sets. With this method, however, reinforcing members sometimes assume a position too close to the bottom of the shell mould (they sink too deep on account of the weighting) and later shine through the finished layer of concrete. This is particularly undesirable in the case of facade units. The distance between the bottom of the mould and the reinforcing constituents is therefore often set by placing the latter on spacers supported on the bottom of the mould.

The disadvantages of this measure are the fact that the spacers are visible at the surface of the first concrete layer, the effort and expense, and the imponderables associated with rather delicate measures of this kind, both during the production of poured-in-place (PIP) concrete components and in the case of prefabricated elements.

SUMMARY

The object of the present invention is to propose a production method for a concrete component, which lessens the aforementioned disadvantages.

Concrete is first of all poured into a preferably flat shell mould. A prefabricated structural element is lowered onto the layer of concrete, which may by all means already contain reinforcing elements, e.g. of steel. This prefabricated structural element comprises first textile reinforcing elements and first insulation elements. The insulation elements confer, among other properties, a fair amount of weight on the reinforcing members, preventing them from floating completely to the surface of the concrete. On the other hand, the specific gravity of the insulation elements—or their density—is much lower than that of concrete, enabling them to prevent the reinforcing members from sinking completely. The prefabricated structural element thus assumes the desired vertical position relative to the concrete layer, enabling the aforementioned disadvantages of the prior art to be avoided.

Among the other advantages of using the prefabricated structural element is that the insulation material, which is often soft yet relatively voluminous and which at least partially surrounds the fragile reinforcing cage during the entire transport to and storage on the construction site, protects or stabilises the reinforcing cage.

The next advantage is that use of the prefabricated structural element cuts transport volume.

With the method disclosed in the DE 100 07 100 B4, both insulation elements and first reinforcing members tie up transport and storage volumes. These volumes are only required once when the prefabricated structural element is used.

A sandwich element can be produced advantageously from a concrete component consisting only of a concrete layer and a prefabricated structural element if an additional, second layer of concrete layer is poured onto the side of the prefabricated structural element facing away from the first concrete layer. This is best done while the first concrete layer and the prefabricated structural element are still in the shell mould. Naturally, however, it is also possible to apply the second concrete layer at a later time.

The two concrete layers may differ in thickness and it is even possible to use different types of concrete to produce them. For example, the first concrete layer may be thinner than the second. Finer-grained concrete may be used to produce the thinner layer than is used to produce the thicker layer. The thinner layer often consists of fair-faced concrete and is often the facing shell. Facing shells are often visible at the front of buildings. The thicker layer is frequently the supporting layer.

It is to advantage if at least some of the textile reinforcement structures contain three-dimensional textile grid structures. Such structures can be made in the run-up to production of the prefabricated structural element and shaped as desired. The grid structures take up areal loads well and may transmit these to the concrete matrix. In the case of panel-shaped components or prefabricated structural elements it is to advantage if some of the grid structures run parallel to the plane of the panel. A "three-dimensional textile grid structure" is obtained, for example, if a reinforcement grid of textile reinforcing material—such as glass fibres or carbon fibres—is shaped in such a way as to be non-planar.

During production of the prefabricated structural element, first insulation elements may be introduced into recesses in the first reinforcing members, possibly to such an extent as to create a form fit. However, it is also possible for a first reinforcement structure to only "loosely embrace" an insulation element, and for the remaining length of the reinforcement structure to project beyond the insulation material and, after production of the concrete component, to be anchored in the concrete matrix. In the latter case, a reinforcement member thus serves simultaneously as connector as defined in this publication.

The recesses may be U-shaped. This shape may be produced by bending originally flat textile grids. Panel-shaped portions of the insulation element(s) may then be introduced into the area of the U-shaped recesses. Of course, the first insulation element(s) may be panel-shaped in their entirety and take the form of Styrofoam or rigid foam boards, for example. Panel-shaped insulation elements are particularly advantageous if the entire prefabricated structural element is intended to assume a panel-like shape. In these cases the length and breadth of the structural element are multiples of its depth.

It is to advantage in this connection if the U-shaped cross section of at least one recess is in the plane defined by the spatial direction of the depth and of the length or breadth of the structural element.

For producing the prefabricated structural element, it is of advantage if first thermal insulation elements are introduced into the structural element in viscous form—i.e. often in the form of foam or of a liquid. The advantages of filling substantial portions of the first reinforcement structure with pour-in place foam or casting resin are especially relevant in the case of a textile concrete reinforcement, as reinforcement structures of this kind are often more delicate and fragile than ones made of construction steel. It is possible to produce structural elements with highly impermeable insulation elements by filling large parts of the volume with foam or casting resin and also by using already-cured insulation elements. This impermeability increases the insulation capacity of the concrete component. It also enhances the "lift" which the prefabricated structural element experiences on the first concrete layer, thereby opposing the above-described tendency of the reinforcement structures to sink too deep.

This effect is increased further if the precision with which the prefabricated structural element fits into the shell mould of the first concrete layer is within the customary tolerances—which are not insubstantial in the construction industry. In this case, no notable concrete displacement can occur, and while the prefabricated structural element is curing, it remains in the position defined by the thickness of the concrete layer.

The procedures described above show that the use of prefabricated structural elements of the described nature is advantageous. These structural elements already comprise first textile reinforcement structures and first insulation elements, meaning that the steps otherwise required to "combine" these two elements, which are normally performed at a construction site (PIP concrete) or in a precast concrete works (prefabricated concrete elements), are no longer necessary at these exposed locations. The prefabricated structural elements may contain little concrete or steel, or they may be configured completely free of concrete or steel so that their transport weight remains low.

As already briefly mentioned, textile reinforcement structures are reinforcement structures that contain textile materials. Among these are mineral fibres, which particularly include glass, ceramic and basalt fibres. The organic-fibre group, which includes carbon fibres, aramide fibres and sometimes even polymer fibres such as polypropylene fibres, also plays a role. In this connection, the first-mentioned glass-fibre materials are often embedded in a polymer matrix so as to protect the glass from the alkaline concrete environment.

Reinforcement grids resembling construction-steel grids are often made from the fibrous material. These grids are produced in the form of woven fabric, preferably, however, in the form of bonded fabric.

The term "thermal insulation element" is based upon the understanding of a person skilled in the art, who will subsume those constituents of the structural element that consist of materials customarily used for purposes of thermal insulation under "thermal insulation elements". Styrofoam or polyurethane foam (generic term: expanded plastics) belong in this category. Mineral wools, such as glass wool and rock wool, must also be mentioned. Materials based on textile waste also belong in this category.

Recently, use has also been made of mineral-type "expanded materials", such as cellular glass.

As mentioned, structural elements of this kind may used advantageously and profitably in the field of PIP concrete and in the manufacture of prefabricated concrete elements. The latter use appears to offer the most advantages.

It is beneficial if prefabricated structural elements are equipped with connectors. Connectors project beyond the first insulation elements, enabling them to engage a concrete matrix when they are processed to form concrete components. Suitable connectors can be connected effectively to further reinforcement structures. For this purpose, the shape of the connector may be optimised (e.g. such that it embraces a round bar in form-fitting manner). To optimise embedment in a concrete matrix, provision may also be made for specific connector shapes, which are mentioned again in this description.

Much of the demand for concrete components of the described nature is likely to be in the field of wall manufacture. It is accordingly advantageous to configure both the prefabricated structural element and the concrete component in the shape of a panel. That means that the length and breadth of the structural elements, which are usually rectangular or square, are much greater than its depth. In the case of flat prefabricated concrete components, various grid structures—whether of textile material or of metal—run parallel to one another area-wise.

It is to advantage if the prefabricated structural element is largely panel-like in shape, with any existing connectors being able to extend beyond the panel-like body. The panel-like body may be filled by the first reinforcing members and the first insulation elements.

The first thermal insulation elements form a barrier against heat loss. It is therefore advantageous if the first thermal insulation elements are not penetrated by metals and/or concrete. Particularly in the case of panel-like components, it is to advantage if the first insulation elements define a plane that is not penetrated or permeated by the aforementioned substances.

Further embodiments of this invention derive from the dependent claims and the description. The description, too, is limited to essential features of the invention, the individual features as a rule being advantageously applicable to all the embodiments. Reference must be made additionally to the drawings.

The technical features of the individual embodiments can, as a rule, be used to advantage with all the embodiments of the invention.

A few selected embodiments of the invention are explained below by reference to the drawings.

DETAILED DESCRIPTION

Figure 10:
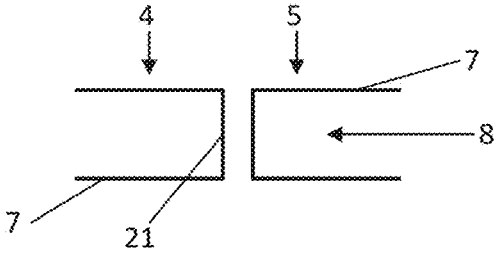
FIG. 10 is an exploded diagram showing the parts of a spacer of the kind depicted in FIGS. 1 to 7.
Figure 1:
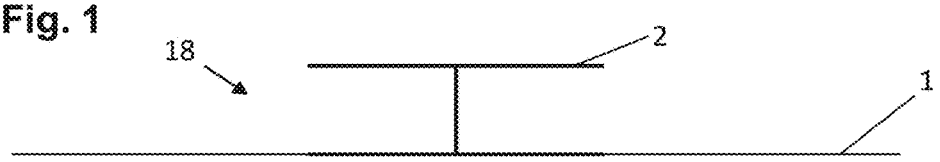
FIG. 1 shows a side view of a prefabricated structural element in the process of being assembled.

FIG. 1 shows a textile grid 1 lying flat on the floor, with a spacer 2 placed upon it. For purposes of assembling the prefabricated structural element 3, the spacer may be fixed in place on the textile grid 1 with a suitable adhesive. The spacer may be configured as a three-dimensional textile grid structure. In this case it may be produced by bending textile grids. For example, two U-shaped grid constituents 4 and 5 may be formed and assembled to create a T-shaped entity (FIG. 10). The bond between the two grid constituents 4 and 5 may also be created with an adhesive. It remains to be mentioned that the drawings show the radii at the connection between the legs 7 of the spacer 2 and its transverse connection 21 to be very small. As a rule, these radii will be considerably larger.

In FIG. 1, the textile grid 1 and the spacer 2 already constitute part of the first reinforcement structures 18.

Figure 2:
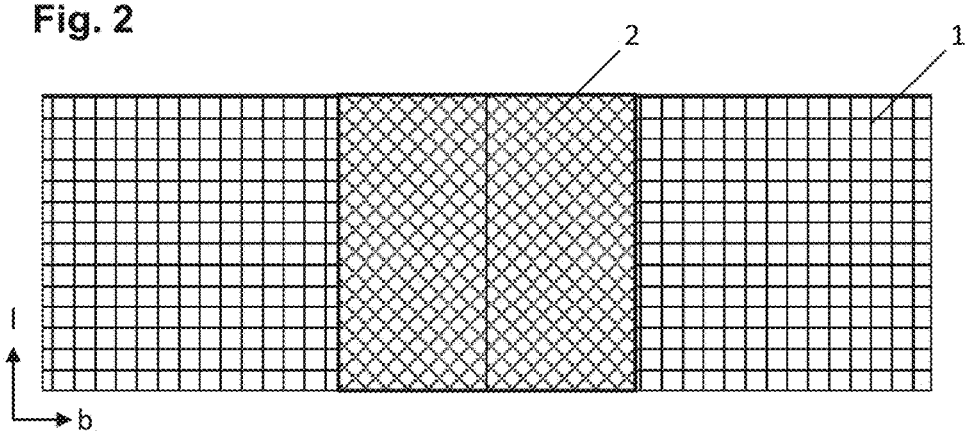
FIG. 2 shows a top view of the prefabricated structural element of FIG. 1.

FIG. 2 shows a top view of the same structural element 3 at the same production stage. The hatching indicates that the fibre strands of the textile grid 1 are oriented at 90° and 180°, respectively, relative to the edges of the textile grid 1. The orientation of the fibre strands of which the spacer 2 consists has been rotated by 45° relative to that of the fibre strands of the textile grid 1, which has advantages. However, depending on the case in question, other angles, such as 0° or 30°, are also possible.

Figure 3:
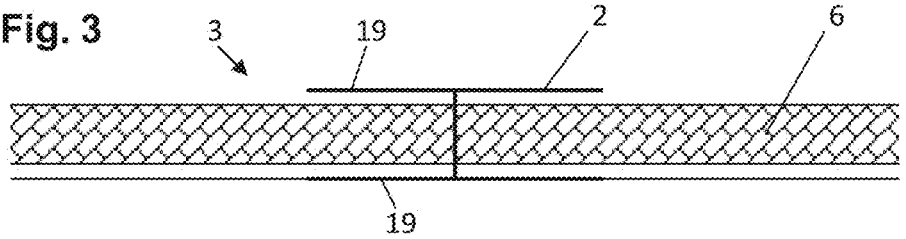
FIG. 3 shows a side view of the prefabricated structural element of FIG. 1, to which first thermal insulation elements have just been added.

FIG. 3 shows a somewhat more advanced production stage of the same structural element 3. The insulation elements 6 have already been inserted into the structural element. It becomes clear from FIGS. 3 and 10 that the spacer 2 and its constituents have several functions:

The legs 7 of the spacer 2 embrace the ends of the insulation elements 6, which are panel-shaped. The legs 7 thus define the recesses 8, into which the insulation elements 6 are inserted.

Figure 4:
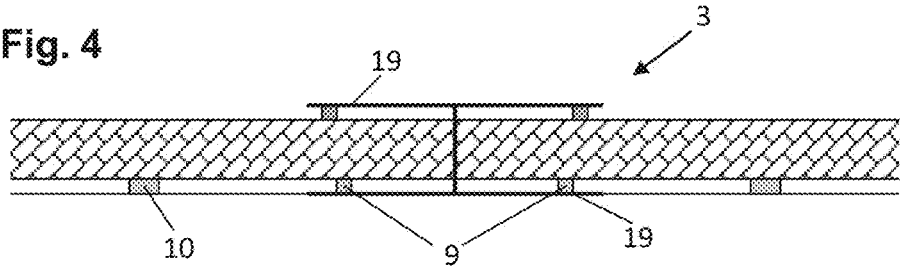
FIG. 4 shows a modification of the prefabricated structural element of FIG. 3 from the side.

The prefabricated structural element 3 in FIG. 4 contains, in addition to the features shown in FIG. 3, distance-keeping elements 9. These ensure that a space is maintained between the insulation elements 6 and the legs 7 of the spacer 2. The distance element 10 maintains the distance between the textile grid 1 and the insulation element 6. The point of this measure becomes clear from FIG. 7:

The textile grid and the legs 7 of the spacer 2 reach deep into the concrete matrix of the first concrete layer 11, so that here, the leg 7 also serves as a connector 19 as defined in this publication.

Figure 5:
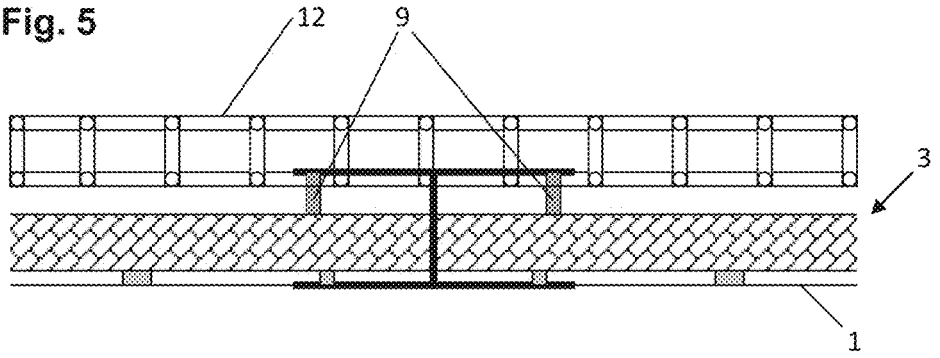
FIG. 5 shows a development of the prefabricated structural element of FIG. 4 from the side.

The assembly of the prefabricated structural element 3 in FIG. 5 corresponds in the first instance with what has already been said in connection with FIG. 4, with the upper spacers 9 defining a somewhat greater distance than do the corresponding spacers 9 in FIG. 4. In FIG. 5, however, another, second reinforcement structure 12 is already visible, which has been added. In the embodiment of FIG. 5, this reinforcement structure consists of metal. It may be added in the customary manner to the prefabricated structural element, which is delivered free of metal, in a precast concrete works or at a construction site. Binding wire, for example, may be used for this purpose.

Figure 6:
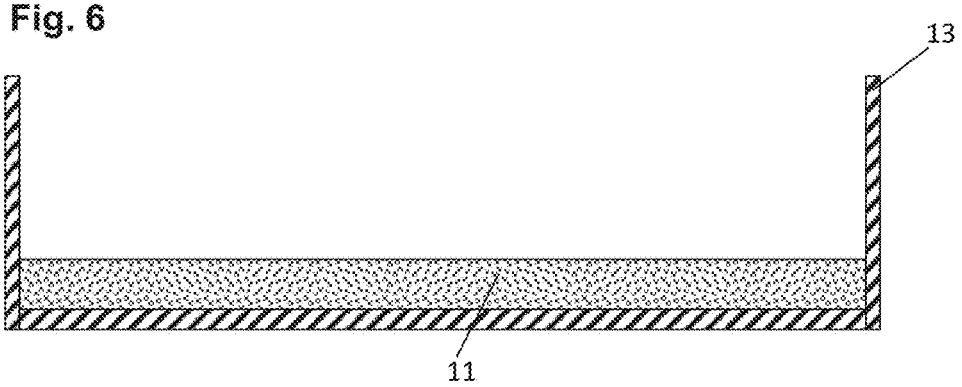
FIG. 6 shows a first concrete layer in a shell mould.

FIG. 6 shows a shell mould 13 containing a first concrete layer 11. A prefabricated structural element 3 may be lowered into a shell mould 13 of this kind. It is to advantage if the precision with which a prefabricated structural element 3 fits into the shell mould 13 is within the tolerances customary in the branch (meant here, in particular, are the tolerances in the l/b plane).

Figure 7:
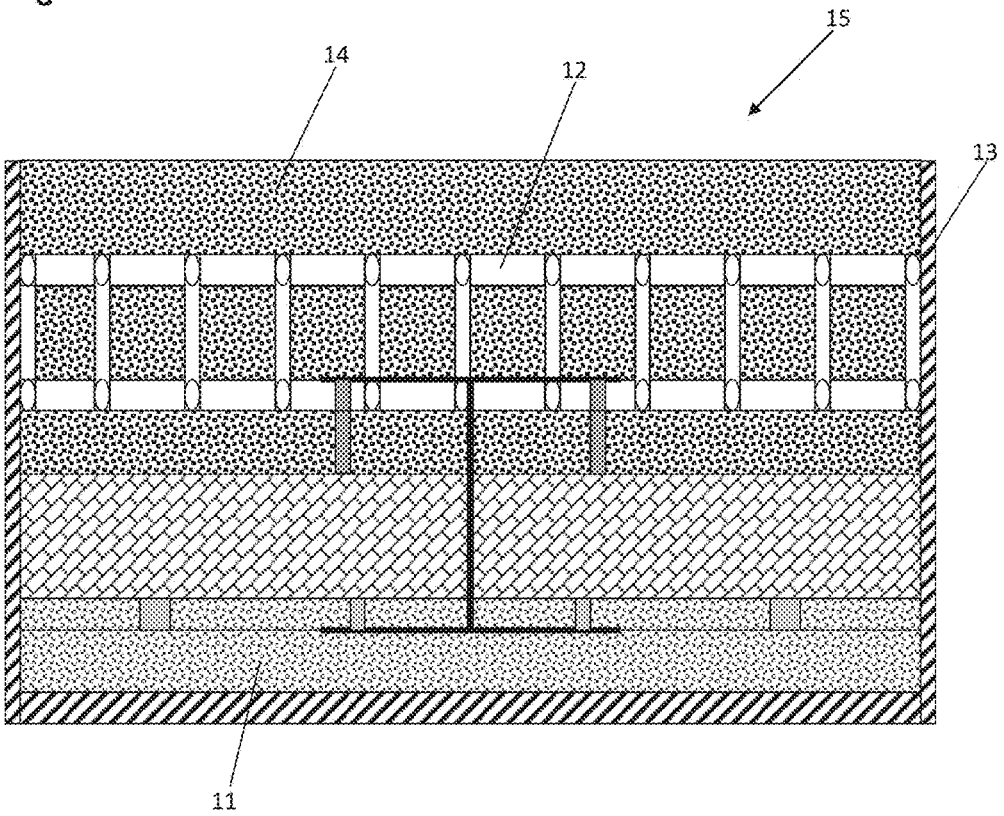
FIG. 7 shows the prefabricated structural element of FIG. 5 in a shell mould and with a first and a second concrete layer.

FIG. 7 shows a situation in which the prefabricated structural element of FIG. 5 has been lowered into the shell mould of FIG. 6, which already contained a first concrete layer 11. FIG. 7 also shows that a second concrete layer 14 has been poured on top of the prefabricated structural element. This second concrete layer is reinforced by the second reinforcement structure 12. Once the concrete layers 11 and 14 have set and hardened, a finished concrete component 15 may be removed from the shell mould 13.

Figure 8:
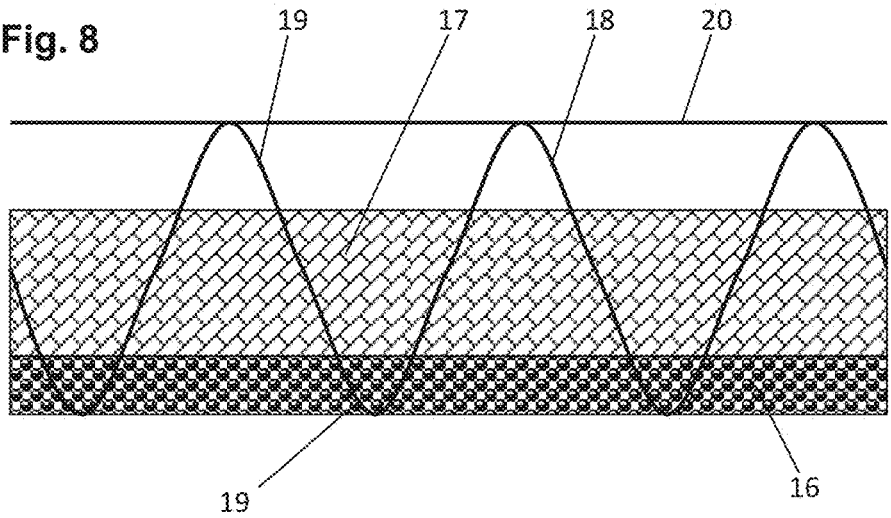
FIG. 8 shows a production stage of another prefabricated structural element.

FIG. 8 shows a production stage of another prefabricated structural element 3 featuring three-dimensional textile reinforcement structures which, in FIG. 8, have a sinusoidal cross section. Reinforcement structures of this kind, too, may be obtained by subjecting textile grids, like the textile grid 1, to a forming process. Particularly in the case of complex textile structures of the kind shown, it is to advantage if insulation elements 6 are combined in the viscous state with the first reinforcing members. The layer of moulding material 16 is shown at the lower edge of FIG. 8. A layer of this kind may consist of sand, for example, or of a heavy medium. The first reinforcement structures 18 have, as mentioned, a sinusoidal cross section. The layer of moulding material 16 has been covered with viscous insulation material 17, which cures with time to form first insulation elements 6. As a rule, the layer of moulding material 16 may be used to produce a plurality of prefabricated structural elements 3. If the layer of moulding material 16 consists of a granular or powdered material, the surface of the layer may be smoothened before a new prefabricated structural element 3 is processed further with the same layer of moulding material. The new prefabricated structural element 3 is then pressed into the mould layer 16 in such manner that a portion of the connecting members 19 dip into this layer 16, preventing them from being surrounded by viscous insulation material 17.

If a heavy liquid—on which a preferably foam-like layer of viscous insulation material floats—is used as the layer of moulding material 16, active smoothing of the surface of the layer 16 is likely to be superfluous.

Figure 9:
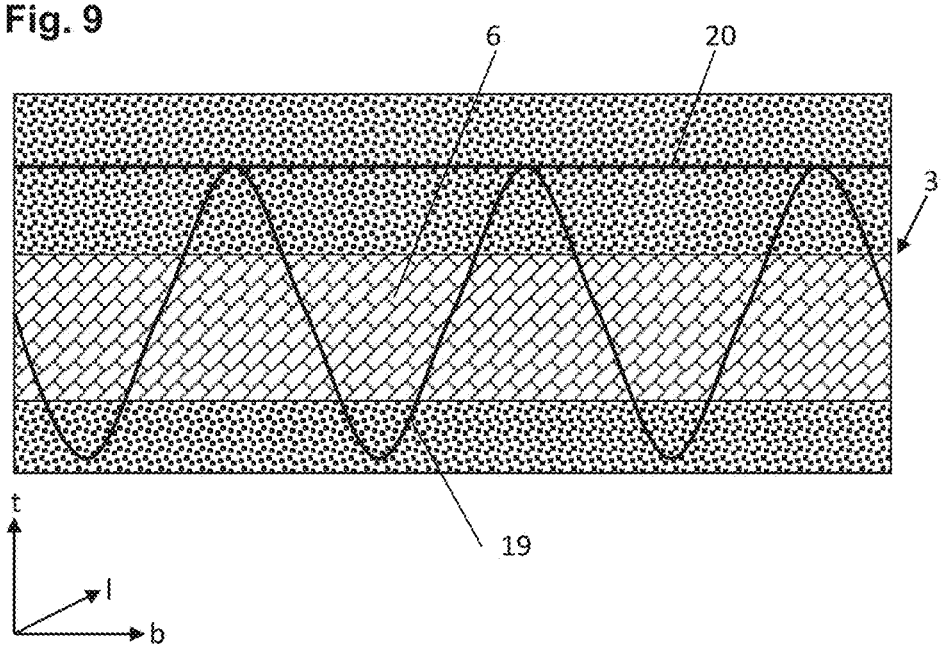
FIG. 9 shows the finished prefabricated structural element of FIG. 8 as part of a concrete component.

FIG. 9 shows a prefabricated structural element 3 that was produced in the described manner. The first thermal insulation elements 6 have already cured. The first and second concrete layers 11, 14 are already in place, so that one can speak of a concrete component—here a "sandwich component".

Yet to be mentioned is the horizontal reinforcing member 20 shown in FIGS. 8 and 9, which improves the anchorage of the first reinforcement structures 18 in the second concrete layer 14.

It is generally to advantage if the insulation elements (6) in prefabricated structural elements (15) are not penetrated by materials that conduct heat well, such as metal or concrete.

The drawings described above show panel-shaped prefabricated structural elements 3 and concrete components 15, which, in turn, contain predominantly panel-shaped insulation elements (6). "Panel-shaped" in this connection means that the depth t of these bodies is substantially less than their length l or breadth b. Particularly in the case of components 15 of such kind, it is to advantage if the insulation elements define a plane (here in the l and b directions), which is not penetrated by materials that conduct heat well.

It is also to advantage if concrete components 15 feature a plurality of grid-like reinforcement structures (some of them made of arbitrarily selected material), which run in the l and b directions.

Figure 11:
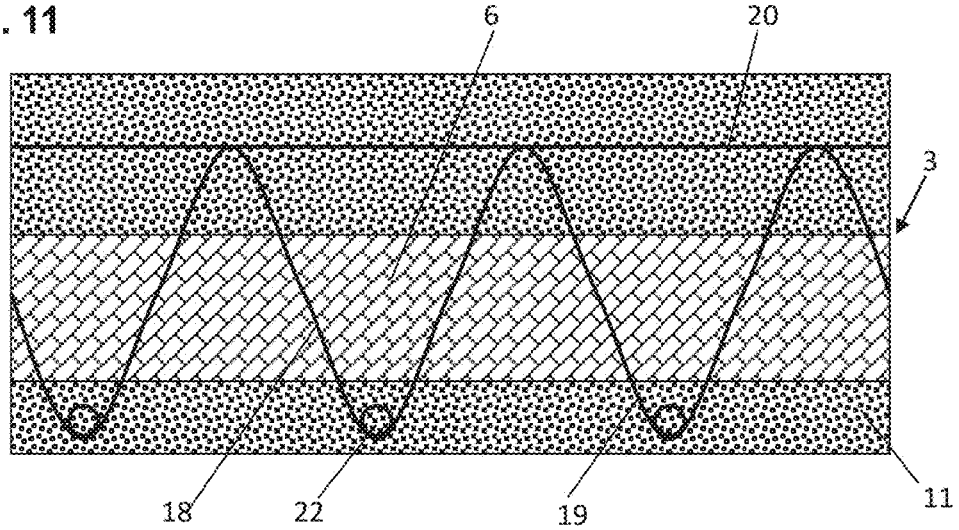
FIG. 11 shows a development of the concrete component of FIG. 9.

FIG. 11 shows a concrete component based on FIG. 9. In addition to the features of the concrete component 15 shown there, FIG. 11 shows cross-sectional surfaces of the transverse rods 22, which are secured in form-locking manner in the first reinforcement structures 18. The transverse rods, too, substantially improve the anchorage of the first reinforcement structures 18 and of the entire prefabricated structural element 3 in the first concrete layer 11. The transverse rods may be made of metal or of a textile reinforcing material.

Figure 12:
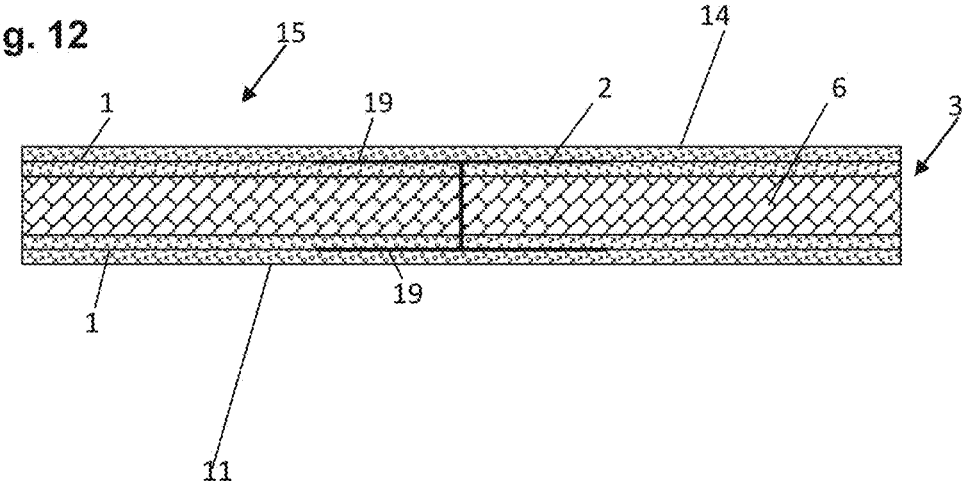
FIG. 12 shows a further embodiment of a concrete component.

FIG. 12 shows an embodiment of a further structural element 3. This structural element has two relatively thin concrete layers 11 and 14, which are advantageously configured such as to be of approximately equal thickness. Both concrete layers may be made of fair-faced concrete and thus serve, for instance, as exposed walls, e.g. in garage construction.

With some of the concrete components 15 shown, it is to advantage to remove the component 15 from the shell mould 13 after the first concrete layer 11 has set and to turn it over. The second concrete layer 14 can then be poured in the same or another shell mould 13. This is done in a manner analogous to the production of the first concrete layer 11, with the second concrete layer 14 being formed in the shell mould 13 and the rest of the later component lowered onto the second concrete layer.

In connection with the insulation materials already mentioned above, it must be added that their mechanical properties may also play a major role. In the case of suitable expanded materials, a distinction is often made between flexible and rigid foams.

Among the problems of processing textile reinforcing materials is the fact that the reinforcement structures are unsuitable for walking on. However, particularly through use of rigid insulation materials—such as rigid foam—as a constituent of the prefabricated structural elements 3, it is possible to create zones, at least, that can be walked on before the concrete layers concerned have set and hardened.

As already mentioned earlier, the first reinforcement structures 18 contain textile reinforcement structures. In all of the embodiments of the invention, it has proved additionally advantageous to also provide the reinforcements of the concrete layers—that is, maybe that of the first 11 and/or of the second concrete layer 14—with textile reinforcement structures. This may be undertaken to such an extent as to render one, or even both, of these concrete layers 11 and 14 free of steel. The entire concrete component may then, if desired, be configured free of steel and free of metal constituents.

Use of the aforementioned measures is particularly advantageous in connection with the last embodiment of a concrete component and its production, which were explained against the background of FIG. 12.

| List of reference numerals | |
|---|---|
| 1 | Textile grid |
| 2 | Spacer |
| 3 | Structural element |
| 4 | U-shaped grid constituent |
| 5 | U-shaped grid constituent |
| 6 | Insulation elements |
| 7 | Leg (of the spacer 2) |
| 8 | Recess (in the spacer 2) |
| 9 | Distance element |
| 10 | Distance element |
| 11 | First concrete layer |
| 12 | Second reinforcement structure |
| 13 | Shell mould |
| 14 | Second concrete layer |
| 15 | Concrete component |
| 16 | Layer of moulding material |
| 17 | Viscous insulation material |
| 18 | First reinforcement structures |
| 19 | Connectors |
| 20 | Horizontal reinforcing member |
| 21 | Transverse connection 21 of the spacer 2 |
| 22 | Transverse rod |

What is claimed is:

1. A method of producing a concrete component, the method comprising:

producing a prefabricated structural element (3), including:

bending a generally flat textile grid into a non-flat orientation with a first portion of the textile grid extending transversely to a second portion thereof;

joining the first portion of the bent textile grid with a generally flat grid to form a first reinforcement structure (18), and introducing a first thermal insulation element (6) to the first reinforcement structure, pouring concrete into a shell mould (13) to form a first concrete layer (11), lowering the prefabricated structural element (3) onto the first concrete layer (11), orienting the prefabricated structural element such that the generally flat grid and the first portion of the bent textile grid is embedded within the first concrete layer.

2. The method according to claim 1, further comprising applying a second concrete layer (14) onto the prefabricated structural element (3).

3. The method according to claim 2, wherein bending the generally flat textile grid into the non-flat orientation comprises bending the textile grid into a U-shaped configuration having a recess between the first portion, second portion, and a third portion of the textile grid that extends generally parallel to one of the first and second portions thereof and transversely to another of the first and second portions; the method further comprising during production of the prefabricated structural element (3), introducing the first insulation element (6) into the recess (8) in the first textile reinforcement structure (18), which at least partially embraces the first insulation element therein.

4. The method according to claim 3, wherein the first insulation element comprises a panel-shaped portion, further comprising introducing the panel-shaped portion of the first insulation element (6) into the recess of the first textile reinforcement structure.

5. The method according to claim 1, further comprising during production of the prefabricated structural element (3), introducing the first thermal insulation element (6), in a liquid or foam form, into an area of the first reinforcement structure (18).

6. The method according to claim 5, further comprising equipping the prefabricated structural element (3) with connectors (19), which (19) are already part of the first reinforcement structure (18), or are firmly connected to the first reinforcement structure (18), at a time at which the liquid or foam is introduced into the area of the first reinforcement structure (18), and which (19) extend beyond the area which becomes filled with the foam or liquid, and which (19) extend into a layer (16) of soft, powdered and/or viscous moulding material while the foam or liquid is curing.

7. The method according to claim 1, further comprising forming at least the first concrete layer (11) in a shell mould (13) and that, on being lowered onto the first concrete layer (11), the prefabricated structural element (3) fits into the shell mould.

8. A prefabricated structural element for a concrete component, the element comprising:

first reinforcement structures (18), which feature a generally flat grid and three-dimensional textile reinforcement structures connected thereto, wherein individual ones of the textile reinforcement structures include a unitary textile grid that is formed into a U-shape via bending, wherein a first portion of the textile grid is connected to the generally flat grid and both the first portion of the textile grid and the generally flat grid are configured to be embedded in a first layer of concrete, a second portion of the textile grid connected to the first portion that extends generally orthogonally from the first portion, and a third portion of the textile grid connected to the second portion that extends generally orthogonally from the second portion, the third portion configured to be embedded in a second layer of concrete, and first thermal insulation elements (6), wherein individual ones of the first thermal insulation elements are disposed between individual ones of the textile reinforcement structures with a portion of the individual ones of the first thermal insulation elements disposed within a void formed by one of the adjacent U-shaped textile reinforcement structures.

9. The prefabricated structural element according to claim 8, further comprising connectors (19), which (19) are part of the first reinforcement structures (18) or are connected firmly to the first reinforcement structures (18), which (19) extend beyond the first insulation elements (6), and which (19) are configured to connect to second reinforcement structures (12) and/or be permanently embedded in a concrete matrix.

10. The prefabricated structural element according to claim 8, wherein the structural element is panel-shaped, such that a length (l) and breadth (b) of the structural element is a multiple of the structural element's depth (t).

11. The prefabricated structural element according to claim 10, wherein the first reinforcement structures (18) and the first insulation elements (6) fill a majority of the prefabricated structural element (3).

12. The prefabricated structural element according to claim 8, wherein the insulation elements (6) define a plane that is not pierced by a metal or concrete material.

13. The prefabricated structural element according to claim 8, wherein the first thermal insulation elements (6) comprise foam insulation materials.

14. A concrete component comprising a prefabricated structural element (3) comprising:

first reinforcement structures (18), which feature a generally flat grid and three-dimensional textile reinforcement structures connected thereto, wherein individual ones of the textile reinforcement structures include a unitary textile grid that is formed into a U-shape via bending, wherein the generally flat grid and a first portion of the textile grid is embedded in a first layer of concrete, a second portion of the textile grid connected to the first portion extends generally orthogonally from the first portion, and a third portion of the textile grid connected to the second portion extends generally orthogonally from the second portion, the third portion embedded in a second layer of concrete, such that each unitary U-shaped textile grid is firmly embedded in both first and second layers of concrete; and first thermal insulation elements (6), wherein a portion of individual ones of the first thermal insulation elements are disposed within individual ones of the U-shaped textile reinforcement structures.

15. A method of producing a prefabricated structural element for use in forming a concrete component, the method comprising:

bending a generally flat first textile grid into a U-shaped configuration with a first portion of the first textile grid extending transversely to a second portion thereof and a third portion that extends generally parallel to the first portion to form at least a portion of a first textile reinforcement structure having a void between the first, second, and third portions;

introducing at least a portion of a first insulation element into the void of the first textile reinforcement structure.

16. The method according to claim 15, wherein the first insulation element is a solid panel-shaped element and introducing the first insulation element into the void includes inserting an end of the first insulation element into the void.

17. The method according to claim 15, further comprising introducing the first thermal insulation element in a liquid or foam form into the void of the first textile reinforcement structure.

18. The method according to claim 15, further comprising bending a generally flat second textile grid into a non-flat orientation with a first portion of the second textile grid extending transversely to a second portion thereof;

joining the second textile grid with the first textile grid to form the first textile reinforcement structure.

19. The method according to claim 18, wherein joining the second textile grid with the first textile grid includes joining the second portion of the first textile grid to the second portion of the second textile grid such that the respective first portions of the first and second textile grids extend generally along the same reference plane.

20. The method according to claim 15, further comprising joining the first textile reinforcement structure to a generally flat grid.

21. The method according to claim 15, further comprising bending a generally flat third textile grid into a U-shaped configuration with a first portion of the third textile grid extending transversely to a second portion thereof and a third portion that extends generally parallel to the first portion to form at least a portion of a second textile reinforcement structure having a void between the first, second, and third portions;

joining the first and second textile reinforcement structures to a generally flat fourth textile grid at spaced apart locations, introducing the first insulation element into the void of the first textile reinforcement structure and between the first and second textile reinforcement structures.

* * * * *